US006403226B1

(12) United States Patent
Biernath et al.

(10) Patent No.: US 6,403,226 B1
(45) Date of Patent: Jun. 11, 2002

(54) ELECTRONIC ASSEMBLIES WITH ELASTOMERIC MEMBERS MADE FROM CURED, ROOM TEMPERATURE CURABLE SILICONE COMPOSITIONS HAVING IMPROVED STRESS RELAXATION RESISTANCE

(75) Inventors: Rolf W. Biernath, Roseville; Mark S. Konings; Robert S. Reylek, both of Minneapolis, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 950 days.

(21) Appl. No.: 08/649,504

(22) Filed: May 17, 1996

(51) Int. Cl.[7] ..... H01R 4/58

(52) U.S. Cl. ..... 428/447; 428/209; 428/450; 439/86; 525/478; 525/479; 528/15; 528/31; 528/32

(58) Field of Search ..... 428/447, 209, 428/450; 439/86; 528/15, 31, 32, 478, 479

(56) References Cited

U.S. PATENT DOCUMENTS

| | | | | |
|---|---|---|---|---|
| 3,065,446 | A | 11/1962 | Robb et al. | 439/496 |
| 3,541,222 | A | 11/1970 | Parks et al. | 174/260 |
| 3,542,939 | A | 11/1970 | Mintz | 174/33 GC |
| 3,609,104 | A | 9/1971 | Ehrreich | 252/511 |
| 3,680,037 | A | 7/1972 | Nellis et al. | 439/591 |
| 3,715,334 | A | 2/1973 | Karstedt | 528/15 |
| 3,743,890 | A | 7/1973 | Neu | 361/806 |
| 3,775,452 | A | 11/1973 | Karstedt | 556/10 |
| 3,795,037 | A | 3/1974 | Luttmer | 29/883 |
| 3,795,884 | A | 3/1974 | Kotaka | 439/591 |
| 3,817,910 | A | 6/1974 | Viksne | 524/456 |
| 3,835,442 | A | 9/1974 | Anderson et al. | 439/86 |
| 3,852,878 | A | 12/1974 | Munro | 29/878 |
| 3,862,790 | A | 1/1975 | Davies et al. | 439/66 |
| 3,870,385 | A | 3/1975 | Avakian et al. | 439/86 |
| 3,871,737 | A | 3/1975 | Dorrell et al. | 439/88 |
| 3,898,397 | A | 8/1975 | Devore et al. | 200/6 A |
| 3,950,300 | A | 4/1976 | Hittmair et al. | 523/109 |
| 3,954,317 | A | 5/1976 | Gilissen et al. | 439/591 |
| 3,967,162 | A | 6/1976 | Ceresa et al. | 361/751 |
| 3,982,320 | A | 9/1976 | Buchoff et al. | 29/883 |
| 3,985,413 | A | 10/1976 | Evans | 439/66 |
| 4,002,621 | A | 1/1977 | Lamp | 439/586 |
| 4,008,300 | A | 2/1977 | Ponn | 264/104 |
| 4,008,519 | A | 2/1977 | Gilissen et al. | 29/877 |
| 4,029,999 | A | 6/1977 | Neumann et al. | 361/704 |
| 4,050,756 | A | 9/1977 | Moore | 439/91 |
| 4,057,311 | A | 11/1977 | Evans | 439/66 |
| 4,064,623 | A | 12/1977 | Moore | 29/876 |
| 4,144,648 | A | 3/1979 | Grovender | 439/331 |
| 4,240,198 | A | 12/1980 | Alonso | 29/876 |
| 4,252,390 | A | 2/1981 | Bowling | 439/73 |
| 4,257,661 | A | 3/1981 | Dalamangas et al. | 439/91 |

(List continued on next page.)

FOREIGN PATENT DOCUMENTS

| | | | |
|---|---|---|---|
| DE | 2918254 A1 | 11/1980 | C08G/77/20 |
| EP | 0 117 056 A2 | 8/1984 | C08L/83/04 |
| EP | 0 632 545 A3 | 1/1995 | H01R/23/72 |
| EP | 0 633 579 A2 | 1/1995 | H01B/3/46 |
| GB | 1 588 527 | 4/1981 | H01R/23/72 |
| GB | 2 061 632 | 5/1981 | H01R/11/01 |
| JP | 56103809 | 8/1981 | H01B/5/14 |
| JP | 57007020 | 1/1982 | H01B/5/14 |
| JP | 57007021 | 1/1982 | H01B/5/14 |
| JP | 58065643 | 4/1983 | B29H/8/00 |

*Primary Examiner*—D. S. Nakarani
(74) *Attorney, Agent, or Firm*—Robert J. Pechman

(57) ABSTRACT

The present invention relates to electronic assemblies which include an elastomeric member made of a cured, room-temperature curable polysiloxane composition. When the assemblies are used to electrically interconnect a first contacting site on a first electronic device to a second contacting site on a second electronic device, the stress-relaxation resistant properties of the elastomer enhance local contact force to maintain a reliable connection.

28 Claims, 3 Drawing Sheets

U.S. PATENT DOCUMENTS 4,311,821 A 1/1982 Weitemeyer et al. ..... 528/15
4,330,165 A 5/1982 Sado ..... 439/91
4,344,662 A 8/1982 Dalamangas et al. ..... 439/91
4,358,172 A 11/1982 Narozny ..... 439/65
4,387,240 A 6/1983 Berg ..... 556/440
4,412,096 A 10/1983 Edgerton et al. ..... 381/60
4,421,370 A 12/1983 Treakle et al. ..... 439/91
4,434,123 A 2/1984 Katumi et al. ..... 264/225
4,476,357 A 10/1984 Malmborg et al. ..... 200/51.09
4,525,528 A 6/1985 Bush et al. ..... 524/860
4,548,451 A 10/1985 Benarr et al. ..... 439/85
4,548,862 A 10/1985 Hartman ..... 428/323
4,636,018 A 1/1987 Stillie ..... 439/66
4,636,019 A 1/1987 Gillett et al. ..... 439/62
4,657,959 A 4/1987 Bryan et al. ..... 524/266
4,693,529 A 9/1987 Stillie ..... 439/67
4,693,530 A 9/1987 Stillie et al. ..... 439/67
4,720,269 A 1/1988 Haskins et al. ..... 439/90
4,778,950 A 10/1988 Lee et al. ..... 174/356
4,798,541 A 1/1989 Porter ..... 439/67
4,815,979 A 3/1989 Porter ..... 439/62
4,818,241 A 4/1989 Smoot ..... 439/65
4,820,170 A 4/1989 Redmond et al. ..... 439/66
4,867,689 A 9/1989 Redmond et al. ..... 439/71
4,879,339 A * 11/1989 Yoshino et al. ..... 524/740
4,918,814 A 4/1990 Redmond et al. ..... 29/878
4,921,453 A 5/1990 O'Brien ..... 439/630
4,932,883 A 6/1990 Hsia et al. ..... 439/66
4,993,482 A 2/1991 Dolbear et al. ..... 165/80.2
4,998,885 A 3/1991 Beaman ..... 439/66
5,009,607 A 4/1991 Gordon et al. ..... 439/67
5,037,312 A 8/1991 Casciotti et al. ..... 439/66
5,041,183 A 8/1991 Nakamura et al. ..... 156/264
5,045,249 A 9/1991 Jin et al. ..... 264/24
5,049,085 A 9/1991 Reylek et al. ..... 439/91
5,059,129 A 10/1991 Brodsky et al. ..... 439/67
5,092,782 A 3/1992 Beaman ..... 439/65
5,101,553 A 4/1992 Carey ..... 29/882
5,123,849 A 6/1992 Deak et al. ..... 439/66
5,123,851 A 6/1992 Young et al. ..... 439/67
5,133,667 A 7/1992 Daughtrey ..... 439/67
5,140,405 A 8/1992 King et al. ..... 357/67
5,141,444 A 8/1992 Redmond et al. ..... 439/59
5,142,444 A 8/1992 Matta et al. ..... 361/386
5,145,381 A 9/1992 Volz ..... 439/62
5,145,886 A 9/1992 Oxman et al. ..... 522/66
5,152,868 A 10/1992 Schiltz et al. ..... 156/643
5,153,244 A 10/1992 Akitomo et al. ..... 524/88
5,161,981 A 11/1992 Deak et al. ..... 439/66
5,162,975 A 11/1992 Matta et al. ..... 361/386
5,163,834 A 11/1992 Chapin et al. ..... 439/66
5,163,836 A 11/1992 Young et al. ..... 439/67
5,171,290 A 12/1992 Olla et al. ..... 439/71
5,180,311 A 1/1993 Schreiber et al. ..... 439/74
5,186,632 A 2/1993 Horton et al. ..... 439/67
5,187,020 A 2/1993 Kwon et al. ..... 428/601
5,197,892 A 3/1993 Yoshizawa et al. ..... 439/91
5,205,751 A 4/1993 Schwartz et al. ..... 439/86
5,216,807 A 6/1993 Yoshizawa et al. ..... 29/876
5,219,922 A 6/1993 Steinberger et al. ..... 524/785
5,244,395 A 9/1993 DeSantis et al. ..... 439/65
5,245,921 A 9/1993 Helinski et al. ..... 101/93.14
5,248,262 A 9/1993 Busacco et al. ..... 439/66
5,259,770 A 11/1993 Bates et al. ..... 439/66
5,260,364 A 11/1993 Johnson ..... 524/413
5,261,158 A 11/1993 Schreiber et al. ..... 29/848
5,265,329 A 11/1993 Jones et al. ..... 29/832
5,273,439 A 12/1993 Szerlip et al. ..... 439/66
5,273,440 A 12/1993 Ashman et al. ..... 439/71
5,275,856 A 1/1994 Calhoun et al. ..... 428/40
5,276,961 A 1/1994 Matta et al. ..... 29/827
5,277,593 A 1/1994 Bates et al. ..... 439/66
5,281,148 A 1/1994 Thompson ..... 439/59
5,297,968 A 3/1994 Johnson et al. ..... 439/67
5,306,162 A 4/1994 Armendariz ..... 439/67
5,313,368 A 5/1994 Volz et al. ..... 361/774
5,316,486 A 5/1994 Tanaka et al. ..... 439/62
5,322,446 A 6/1994 Cearley-Cabbiness ..... 439/73
5,338,209 A 8/1994 Brooks et al. ..... 439/66
5,340,296 A 8/1994 Schreiber et al. ..... 425/123
5,340,318 A 8/1994 Kunihiro ..... 439/66
5,345,364 A 9/1994 Biernath ..... 361/749
5,350,308 A 9/1994 Laska et al. ..... 439/91
5,371,162 A 12/1994 Konings et al. ..... 528/15
5,371,654 A 12/1994 Beaman et al. ..... 361/744
5,374,196 A 12/1994 Horine ..... 439/65
5,376,008 A 12/1994 Rodriguez ..... 439/66

* cited by examiner

ELECTRONIC ASSEMBLIES WITH ELASTOMERIC MEMBERS MADE FROM CURED, ROOM TEMPERATURE CURABLE SILICONE COMPOSITIONS HAVING IMPROVED STRESS RELAXATION RESISTANCE

BACKGROUND OF THE INVENTION

1. Field of the Invention

The present invention relates to electronic assemblies for electronic interconnect applications. More particularly, the present invention relates to electronic assemblies which include an elastomeric member made of a cured, room-temperature curable polysiloxane composition. When the assemblies are used to electrically interconnect a first contacting site on a first electronic device to a second contacting site on a second electronic device, the stress-relaxation resistant properties of the elastomer enhance local contact force to maintain a reliable connection. In addition these polysiloxane compositions exhibit exceptional stress-relaxation resistance during high temperature aging.

2. Description of Related Art

Conventional electrical connectors using metal pin and spring beam contacts cannot be easily miniaturized to satisfy the anticipated pin count density for high performance electronic devices. The electrical characteristics of these connectors cannot meet requirements such as propagation delay, risetime degradation, reflection, and crosstalk. The increasing demand for higher speeds and higher I/O contact density in electronic devices has led to the development of new connectors which utilize non-metallic components to produce and maintain contact force.

For example, some connectors are no more than elastomeric matrices loaded with electrically conductive materials. The elastomeric matrix is placed between the contacts on a first electronic device and the contacts on a second electronic device, the devices are pressed together, and the conductive materials provide electrical interconnection. Such connectors are well known, and examples are shown in U.S. Pat. No. 5,049,085 to Reylek, U.S. Pat. No. 4,008,300 to Ponn, U.S. Pat. No. 5,037,312 to Casciotti et al., U.S. Pat. No. 5,275,856 to Calhoun, and U.S. Pat. No. 4,003,621 to Lamp. The connectors described in these patents utilize a wide variety of elastomeric materials, including butadiene-styrene, butadiene-acrylonitrile and butadiene-isobutylene rubbers, chloroprene and polysulfide polymers, polyvinyl chloride, vinyl acetates, polyurethanes and silicone rubbers. The '621 patent to Lamp states that silicones are preferred, and these materials may be selected from dimethyl, methyl-phenyl, methyl-vinyl or halogenated siloxanes. These silicones may be cured with peroxides or metal salts. The Lamp '621 patent further states that a useful silicone should not deform under its own weight and should not plastically deform after curing.

In some applications, particularly with flexible circuits, the standard metal pin and metal spring socket contact is replaced with a contact in which electrical interconnection is established by mechanically pressing a first contact pad on the circuit to a second contact pad on the connector, device or other circuit. The pressure connections are normally made with a resilient pressure applicator, such as an elastomeric member. The elastomeric member is compressed to bias at least one of the components to be electrically interconnected toward the other components to hold the contact pads thereof in electrical contact. Examples include U.S. Pat. No. 5,009,607 to Gordon et al., U.S. Pat. No. 5,186,632 to Horton et al., U.S. Pat. No. 5,059,129 to Brodsky et al., U.S. Pat. No. 5,313,368 to Volz et al., U.S. Pat. No. 4,636,018 to Stillie, and U.S. Pat. No. 3,967,162 to Ceresa et al. These patents teach that a wide variety of polymeric materials may be used as the elastomeric member, and silicone rubbers are in many cases preferred. For example, the '129 patent to Brodsky states that important properties of the elastomeric material include long-term stress retention, low magnitude pressure against the contacts, and resistance to high temperatures, solvents and humidity. The preferred elastomeric material in the '129 patent is a low compression set polysiloxane (silicone) rubber.

In addition, it is well known that elastomeric compressive members may be used to bias a component against a connector, a circuit, or another device. Examples include U.S. Pat. No. 5,345,364 to Biernath, U.S. Pat. No. 4,867,689 to Redmond et al., and U.S. Pat. No. 4,548,451 to Benarr et al. For example, the '451 patent to Benarr states that any elastomeric material which maintains a "uniform compressive force" may be used as the compressive member, such as silicone or polyurethane. The '364 patent to Biernath states that the elastomeric component may comprise rubbers, foams and the like.

Therefore, it is well known to use rubbery materials, particularly silicones, with low compression set as an elastomeric member in an electronic connector. Compression set resistance is defined as the ability of an elastomeric material to recover its pre-stressed shape after removal of the stressing members (ASTM D 395). The compression set resistance is a measure of a dimensional change in an elastomeric material following removal of an applied stress.

However, the principal function of an electrical connector is to maintain electrical interconnection between a first set of contacts on a first device and a second set of contacts on a second device. If reliable electrical interconnection is to be maintained, the force applied by the connector at the contact interface must remain substantially constant, especially when the connector is exposed to an externally applied mechanical force, or to environmental stresses such as heat, humidity, solvents, and the like. If an elastomer is used as a component part of such a connector, the elastomer selected must have the ability to maintain the normal force at the contact interface, which is referred to in the art as the "contact force," rather than simply maintaining its pre-stressed dimensional shape.

Force-bearing elastomers in electronic components must have stable force-bearing capabilities at high temperatures for long durations of time (e.g., 1000 hours at 125° C.). These requirements are dictated by their usage and standardized by standards organizations (See, for example: Military Standard 1344A *Test Methods for Electrical Connectors*.).

If the resistance at the contact interface is to remain low and the contact force is to remain high, the normal force exerted by the silicone elastomer at the contact interface must remain high following extended exposure to mechanical force and to the environment. Therefore, for electronic connectors, a silicone elastomeric material is needed in which a high percentage of this normal force is retained in the portion of the elastomer adjacent to the contact interface following exposure to mechanical and environmental stress. The proper parameter to measure a silicone elastomer's suitability for use in electronic connectors is the stress relaxation resistance, which is a measure of the percent of the applied mechanical force retained by the material after exposure to both mechanical stress and the environment.

The references discussed above teach that an elastomer with low compression set, preferably a silicone elastomer, is well suited to maintain electrical interconnection in an electronic device. However, there is no direct correlation that can be established between compression set resistance (a dimensional property) and stress relaxation resistance (a force/pressure property). For example, an elastomer that exhibits 100% initial size recovery (thus, 0% compression set) after aging may require only a fraction of the initial force loading to re-compress the material. The compression set resistance of a silicone elastomeric material is therefore an insufficient measure of its suitability to maintain contact force in an electronic connector application.

In addition to the requirement of excellent stress relaxation resistance, a silicone elastomeric material selected for use in an electronic connector must be easily moldable to a wide variety of highly precise shapes. The silicone must flow easily to adapt to the precise dimensions of the mold. During the curing process, the silicone must retain high dimensional accuracy. Changes in contact normal force may result from dimensional variations, so the electrical interconnection of precision electronic components can be adversely affected by dimensional changes. Some elastomers may also require precise lateral dimensional accuracy in some designs to ensure proper alignment between their conductive regions and the contact pads to be interconnected. The silicone must also be rapidly curable at a low temperature. Extended cure times are unacceptable for commercial production processes and the high temperatures may damage delicate electronic components. In addition, high curing temperatures may adversely affect the dimensional accuracy of the molded material. Further, the curing process must not produce by-products that can damage or corrode delicate electronic components.

At present, no silicone elastomeric material is available which has the above combination of properties. In fact, as noted above, the silicone elastomers which are presently available have excellent compression set resistance, which is of little or no import for electronic connector applications. In addition, it is conventionally taught that a high temperature cure is required to achieve compression set resistance. For example, U.S. Pat. No. 5,219,922, Dow Corning product literature, p. 60, form #10-008F-91, and U.S. Pat. Nos. 5,153,244, 5,219,922, and 5,260,364 suggest that a high temperature cure is required to produce an elastomer with high temperature compression set stability. These patents and publications suggest that the requirement of high temperature force-bearing stability conflicts with the requirement for low temperature cure.

It is also generally understood and practiced that the platinum catalyst concentration should be minimized in silicone elastomer compositions, primarily due to economic considerations (U.S. Pat. No. 5,153,244). A lower limit of 0.1 million parts (ppm) by weight platinum metal per the combined weight of all the reactive ingredients is specified, below which the cure does not proceed satisfactorily.

It would be desirable to provide a silicone elastomeric material with the precise combination of properties required for electronic connector applications, such as excellent stress relaxation resistance, low temperature cure, excellent dimensional stability, and an absence of detrimental reaction byproducts. The present invention is based on such a finding.

SUMMARY OF THE INVENTION

The present invention is an electronic assembly comprising a force bearing member made of an elastomeric cured silicone composition. The silicone composition used to make the elastomeric member comprises:

a) an addition curable silicone polymer comprising an average of at least 2 unsaturated functional groups, preferably vinyl, per molecule;

b) a crosslinker comprising an average of at least 2 silicon-hydrogen linkages per molecule; and c) a catalyst, preferably comprising platinum.

The catalyst is present in an amount sufficient to permit curing of the composition in less than about 1 hour at a temperature of about 30° C. Preferably, following curing, the composition has a predetermined stress relaxation resistance, preferably at least 75%, as measured according to a modified procedure described in ASTM-395 (measured as percent force retained).

The cured silicone elastomeric composition of the present invention has an improved stress-relaxation resistance compared to conventional silicone elastomers. These properties enable the elastomeric member to maintain a predetermined level of contact force to ensure reliable electrical interconnection for extended periods. The elastomeric member may act as a spring member, a force distributor, and/or a compliant layer in the electronic connector assembly. The silicone composition of the invention cures rapidly at low temperature, retains excellent dimensional stability during the curing process and thereafter, and does not release detrimental by-products during the curing process.

In one embodiment, the present invention provides an electronic connector subassembly which includes an elastomeric member with at least one electronic contacting site adjacent thereto. The first contacting site on the subassembly may be placed in contact with at least a second contacting site on another device or circuit structure, such as, for example, a circuit board, a flexible circuit, or an electronic component. A mechanical force may be placed on the subassembly to bias the elastomeric member and maintain electrical interconnection between the first contacting site and the second contacting site. The elastomeric member is made of the cured silicone composition described above.

In another embodiment, the present invention provides an electronic assembly which comprises a female member with a first contacting site, and a male member with a second contacting site. An elastomeric member made of the cured, silicone composition described above is positioned between the female member and the first contacting site, or between the male member and the second contacting site, or both. When the male member is inserted into the female member, a mechanical force is applied to bias the elastomeric member (s) and maintain a reliable electrical interconnection between the first contacting site and the second contacting site. The elastomeric member(s) acts as a spring member and/or a force distributor in the electronic connector assembly.

In yet another embodiment, the present invention provides an electronic assembly comprising a first substrate such as, for example, a printed circuit board, with a first electronic device mounted on and/or electrically interconnected thereto. The first device, or the first substrate itself, or both, has at least one first electrical contacting site. A second substrate may have a second electronic device mounted on and/or electrically interconnected thereto. The second device, or the second substrate itself, or both, has at least one second contacting site. An elastomeric member made of the cured silicone composition described above may be placed between the first substrate and the first contacting site, or between the second substrate and the second contacting site, or both. A mechanical force is then applied to bias the elastomeric member and maintain an electrical and/or thermal interconnection between the first contacting site on the first substrate or first device and the second contacting site on the second substrate or device. The member(s) made from the cured silicone elastomer acts as at least one of a force distributor, a spring member, a planarity compensator, or a thermal mismatch buffer, and mechanically decouples the electronic devices from the substrate.

In another embodiment, the present invention includes an electronic assembly which comprises a first electronic component with a first contacting site and a second electronic component with a second contacting site. An elastomeric member made of the cured silicone composition described above may then be placed between the first contacting site and the second contacting site. The elastomeric member may be loaded with conductive particles or provided with an array of discrete conductive members to form at least one conductive path between the first contacting site and the second contacting site. When a mechanical force is applied to the assembly to bias the elastomeric member, the elastomeric member again acts as at least one of a force distributor, a spring member, a planarity compensator, or a thermal mismatch buffer to reliably electrically and/or thermally interconnect the first site to the second site.

In each of the above electronic assemblies, the dimensional stability and excellent stress relaxation resistance properties of the elastomeric members made from the cured silicone composition of the invention are used to advantage to provide local force concentration to maintain contact force at the interface between the respective contacting sites and ensure reliable electrical interconnection. The elastomeric members also provide local compliance and adjust for a wide variety of dimensional differences, such as, for example, the height of the contacting sites or defects in the substrates.

DETAILED DESCRIPTION OF THE PREFERRED EMBODIMENTS

The stress relaxation resistant properties of the elastomeric member(s) in the electronic assemblies of the present invention may provide benefits whenever the elastomeric members bear force in a particular connector application. The term "force-bearing," as used herein, means that at some point in the course of its usage, the elastomeric member is required to bear an externally applied mechanical load. This load may be applied once or repeatedly, for durations of any length of time. The load may be compressive or tensile, or some combination thereof.

Figure 1:
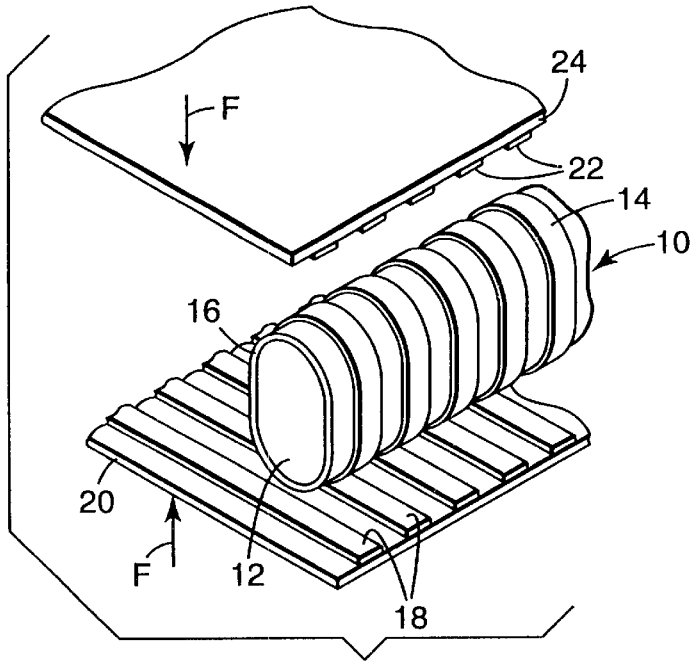
FIG. 1 is a perspective view of an embodiment of an electronic assembly of the present invention.

Referring to FIG. 1, an electronic connector subassembly 10 is shown which includes an elastomeric core member 12. Adjacent the core member 12 are a plurality of finely spaced, metallic electronic contacting sites 14 provided on the surface of a flexible polymeric film 16, such as, for example a polyimide (referred to hereinafter as a "flex circuit"). Typically, the polymeric film 16 is attached to the core member 12 with a suitable adhesive (not shown). The contacting sites 14 are contacted with a plurality of corresponding contacting sites 18 on an electronic component such as, for example, a circuit board 20. The term "electronic component," or "electronic device," as used herein, refers to a construction which is intended to in some way conduct or pass electricity. This includes electronic connectors, flex circuit based connectors, printed circuit board based connectors, conductive elastomers, z-axis conductive elastomers, test-sockets, production sockets, memory card connectors, and the like.

A second group of contacting sites 22 on a second circuit board 24 may also be placed in contact with the contacting sites 14 in the subassembly 10 to provide electrical interconnection between the circuit boards 20 and 24. An external, compressive mechanical force in a direction F may be placed on the circuit boards to bias the elastomeric core 12 of the subassembly. When the compressive force is applied, the generally ovoid shape of the cross section of the elastomeric core 12 in series with the force provides high local contact force at the interface between the contacting sites 14 on the subassembly 10 and the contacting sites 18, 22 on the circuit boards 20, 24. The stress relaxation resistant properties of the elastomeric material making up the core 12 maintain this high local contact force and preserve electrical interconnection.

Figure 2:
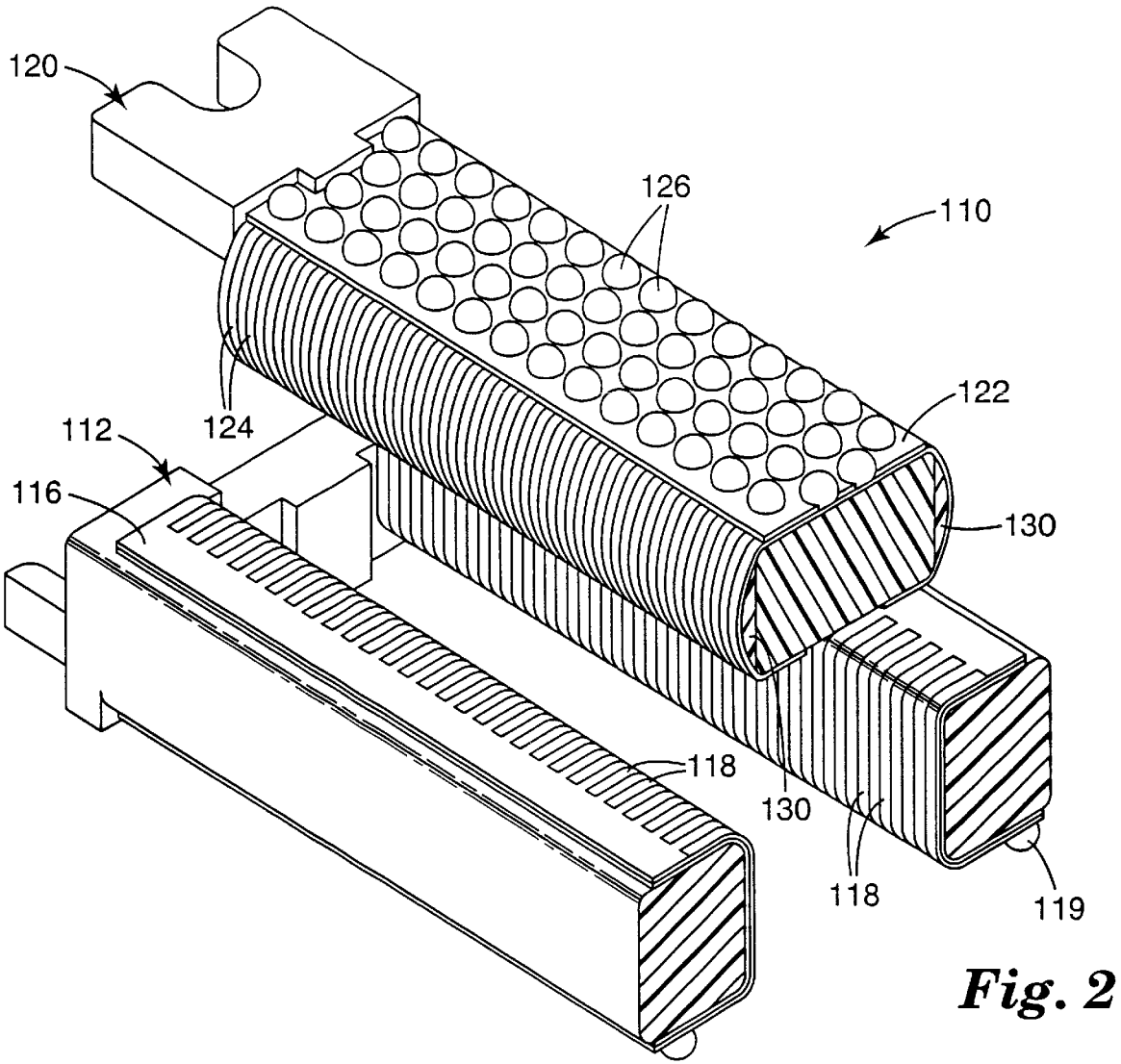
FIG. 2 is a perspective view of an embodiment of an electronic assembly of the present invention which comprises a male member and a female member.

A second embodiment of the electronic assembly 110 of the present invention is shown in FIG. 2. A female member 112 includes a tapered socket-like area 114. A flexible circuit 116 is mounted on the interior walls of the socket-like area 114 with a suitable adhesive. The flexible circuit 116 includes a first array of metallic electrical contacting sites 118, which may optionally include an array of metallic bump-like projections 119 for electrical interconnection to a circuit board (not shown) or another flexible circuit (not shown).

A second flexible circuit 122 is adhesively mounted to a wedge-like male member 120. The flexible circuit includes a second array of metallic electrical bonding sites 124. The metallic bonding sites may further include an array of metallic bump-like projections 126 for electrical interconnection to a circuit board (not shown) or another flexible circuit (not shown). An elastomeric member 130 is positioned between the male member 120 and the flexible circuit 122. The male member 120 is adapted to fit securely onto the tapered socket-like area 114 of the female member, and when so inserted the first array of metallic bonding sites 118 on the flexible circuit 116 attached to the female member 112 is electrically interconnected to the second array of metallic bonding sites 124 on the flexible circuit 122 attached to the male member 120. When the male member 120 is wedged into the female member 112, the elastomeric member 130 is biased, and its oval cross-section applies a spring-like force to maintain contact force between the electrically interconnected bonding sites 118 and 124.

Figure 3A:
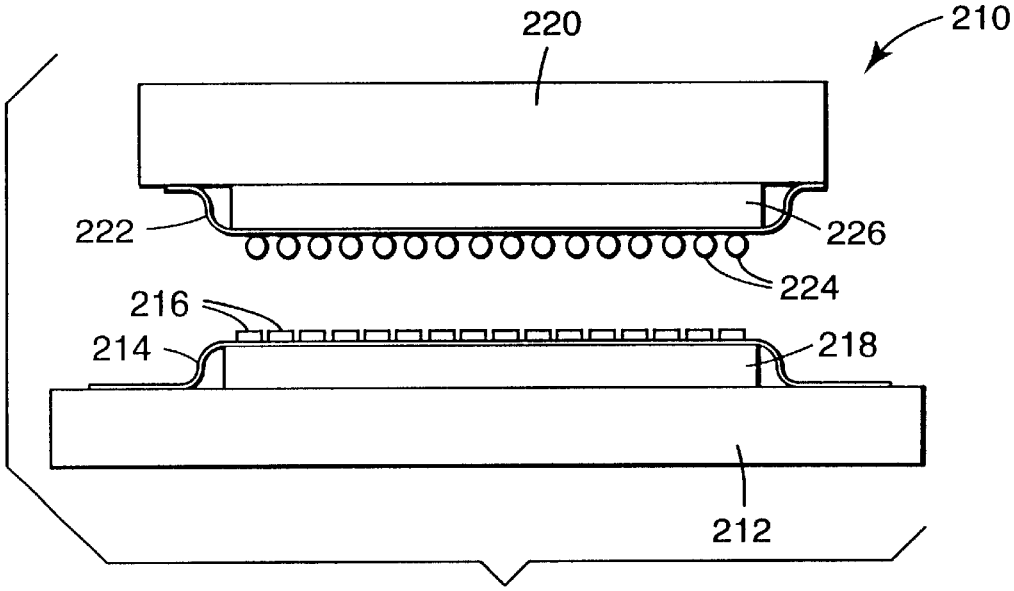
FIG. 3A is a cross-sectional view of an embodiment of an electronic assembly of the present invention which comprises a first substrate and a second substrate, with the assembly in an unconnected state.

In another embodiment of the electronic assembly 210 of the present invention shown in FIG. 3A, a first substrate such as, for example, a printed circuit board 212, includes a first flexible circuit 214 mounted on and/or electrically interconnected thereto. The flexible circuit 214 includes a first array of metallic electrical contacting sites 216. A first elastomeric member 218 of the cured silicone composition of the invention is positioned between the circuit board 212 and the contacting sites 216 on the flexible circuit 214. A second substrate, such as, for example, an integrated circuit chip 220, has a second flexible circuit 222 attached thereto. The second flexible circuit 222 includes a second array of metallic electrical contacting sites 224. An optional second elastomeric member 226 made of the cured silicone composition of the invention is positioned between the chip 220 and the contacting sites 224 on the flexible circuit 222.

Figure 3B:
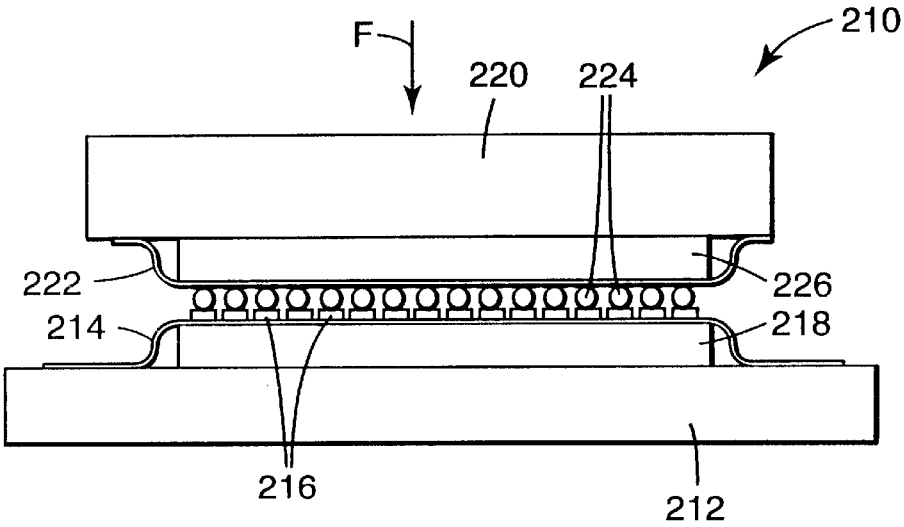
FIG. 3B is a cross-sectional view of an embodiment of an electronic assembly of FIG. 3A in a connected state.

As shown in FIG. 3B, compressive force may be applied in a direction F by any means, such as by a housing (not shown) or a clamp (not shown), to press together metallic contacting sites 216 and 224 to bias the elastomeric members and provide electrical interconnection between the circuit board 212 and the chip 220. The elastomeric members 218 and 226 act as at least one of a force spreader, a spring member, a planarity compensator, or a thermal mismatch buffer. The elastomeric members 218 and 226 mechanically decouple the chip 220 from the circuit board 212 and allow the devices to operate independently of one another. The device shown in FIGS. 3A and 3 B is expected to be quite useful in the testing of integrated circuit devices, where the connections are of relatively short duration. In the alternative, the stress relaxation resistant properties of the elastomeric members provide a high local contact force to maintain electrical interconnection over extended periods.

Figure 4:
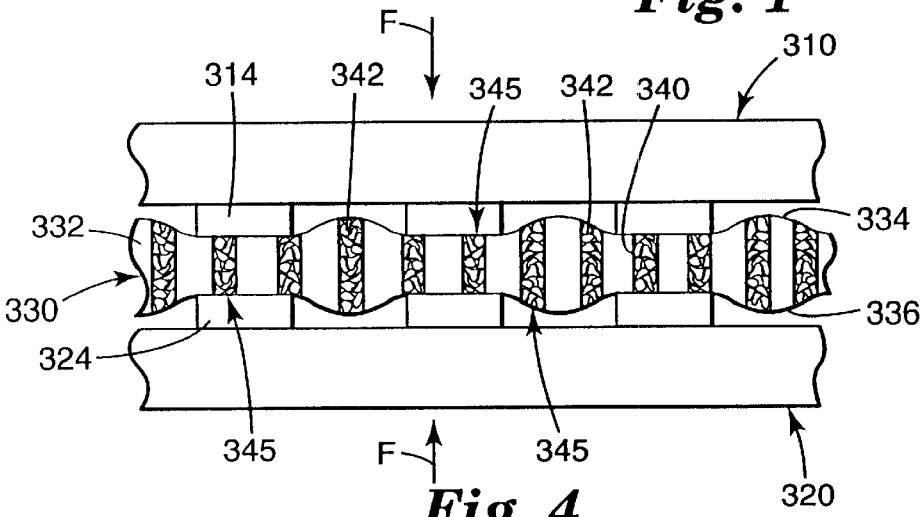
FIG. 4 is a cross-sectional view of an embodiment of an electronic assembly of the present invention with an elastomeric member having conductive pathways.

In yet another embodiment of an electronic assembly 300 of the present invention shown in FIG. 4, a first electronic device 310 includes a first set of metallic contacting sites 314. A second electronic device 320 includes a second set of metallic contacting sites 324. An elastomeric member 330 may be provided in the form of a matrix 332 with a first surface 334 and a second surface 336. In this embodiment, the matrix 332 includes at least one, preferably a plurality, of transverse vias 340 which extend from the first surface 334 of the matrix 332 to the second surface 336 thereof. The vias 340 may contain electrically or thermally conductive elements 342, such as, for example, metallic or ceramic particles, metal coated polymeric and ceramic particles, portions of metallic wires, and the like, preferably in combination with a metallic or polymeric binder. (See co-filed U.S. application Ser. No. 08/651,185, now U.S. Pat. No. 5,890,915 to Reylek.) In an alternative construction not shown in FIG. 4, the elastomeric matrix 332 may be loaded with randomly distributed conductive elements, or with conductive elements positioned at discrete locations to form a conductive pathway or pathways between contacting sites 314 and 324.

When a compressive connecting force F is applied to the first device 310 and the second device 320 by, for example, a resilient housing or a clamping member (not shown in FIG. 4), the conductive elements interact with one another, with the material making up the matrix 332, and with optional binders to function as conductive members 345 and electrically and/or thermally interconnect the contacting sites 314 and 324 on the first and second electronic devices, respectively. The rigidity, electrical characteristics and thermal characteristics of these conductive members 45 may be finely tuned for specific interconnect applications. When the force is applied to compress the electronic assembly 300, the stress relaxation resistant cured silicone elastomer again acts as at least one of a force distributor, a spring member, a planarity compensator, or a thermal mismatch buffer to enhance the reliability of the electrical or thermal interconnection.

The silicone compositions used to make the elastomeric members in the electrical connectors of the present invention comprise:

a) an addition curable silicone polymer comprising an average of at least 2 unsaturated functional groups per molecule;

b) a crosslinker comprising an average of at least 2 silicon-hydrogen linkages per molecule; and c) a catalyst present in an amount sufficient to permit curing of the composition in less than about 1 hour at a temperature of about 30° C.

Preferably, following curing, the composition has a predetermined stress relaxation resistance as measured according to a modified procedure described generally in ASTM-395.

The cured silicone elastomeric composition of the present invention has an improved stress-relaxation resistance compared to conventional silicone elastomers, which enable the elastomeric member to maintain a predetermined level of contact force to ensure reliable electrical interconnection for extended periods of time. The silicone compositions of the invention cure rapidly at low temperature, retain excellent dimensional stability during the curing process and thereafter, and do not release detrimental byproducts during the curing process.

The components of the silicone compositions of the invention are described below.

(1) Addition-Curable Silicone Polymer

A silicone polymer is the first component used in the silicone compositions from which the elastomeric members in the electronic connectors of the present invention are made. These polymeric materials, which are known in the art as addition-curable compounds, are synthetic polymeric silicone materials that possess an extraordinarily wide range of physical properties. They can be low- or high-viscosity liquids, solid resins, or vulcanizable gums. A unique molecular structure of alternating silicon and oxygen atoms provide the addition curable silicone polymers with an unusual combination of organic and inorganic chemical properties. Suitable silicone polymers are well-known in the art and are described, for example, in "Silicones," *Kirk-Othmer Encyclopedia of Chemical Technology,* 3rd Ed., 20, 922–962(1982).

Suitable addition-curable silicone polymers for use in the present invention include ethylenically unsaturated compounds which undergo a crosslinking reaction with a crosslinker in the presence of a hydrosilation catalyst. Typically, the rate of the crosslinking reaction is increased by a catalyst compound and may be affected by temperature (e.g., the reaction may proceed at a somewhat greater rate at an elevated temperature or alternatively may be initiated at an elevated temperature). Preferred ethylenically unsaturated compounds include monomers, oligomers or polymers which comprise pendant or terminal ethylenically unsaturated groups that react with the crosslinker in the presence of a catalyst. Alternatively, the reactive group(s) may be situated along the polymer chain (i.e., along the backbone) and not in a pendant position.

In general, the cured composition's backbone network or structure comprises both the formerly ethylenically unsaturated compound and the crosslinker. Either compound could be employed in greater or lesser proportion or have greater or lesser initial molecular weight. Furthermore, depending on the combination of ethylenically unsaturated compound and crosslinker, one could utilize a broad variety of backbones in these compounds and thereby achieve a broad variety of cured compositions having a wide range of physical properties.

Addition-curable compounds containing aliphatic unsaturation which are useful in the present invention have olefinic or acetylenic unsaturation. These compounds are well-known in the art of hydrosilation and are disclosed in such patents as U.S. Pat. No. 3,159,662 (Ashby), U.S. Pat. No. 3,220,972 (Lamoreaux), and U.S. Pat. No. 3,410,886 (Joy) which are herein incorporated by reference. Additional particularly useful unsaturated compounds which contain silicon are disclosed in U.S. Pat. No. 4,916,169 (Boardman et al.) which is incorporated herein by reference.

The typical addition curable silicone polymer is the siloxane polymer depicted below in formula F1.

(F1)

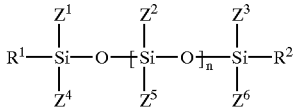

The groups $R^1$ and $R^2$ of formula (F1) represent the "terminal" portions of the polymer chain and are preferably the sites for the attachment of the reactive which participate in the crosslinking reaction (referred to herein as "functional groups"). The non-terminal sites along the backbone in formula (F1) may also be a site for attachment of a functional group, and in such a case the terminal sites $R^1$ and/or $R^2$ then may comprise a non-functional group, such as, for example, a methyl group or another monovalent hydrocarbyl or halogenated monovalent hydrocarbyl group as listed below. Therefore, formula (F1) is intended merely to illustrate a preferred organopolysiloxane polymer with terminal functional groups. The site of attachment of the two or more functional groups may be varied as desired.

The number of functional groups in the organopolysiloxane may vary widely depending on the intended application, but an average of at least two functional groups per polymer molecule is required.

The two or more functional groups in formula F1 are in general substituted and unsubstituted unsaturated aliphatic groups having 2 to 20 carbon atoms, such as alkenyl groups including vinyl, allyl, butenyl, propenyl, isopropenyl, and hexenyl groups or cycloalkenyl groups including cyclohexenyl, cyclopentenyl, cycloheptenyl and cyclooctenyl groups. Substituents may include, for example, halogens, cyano and amino groups. A preferred unsaturated aliphatic group is vinyl. Most preferably, both functional groups are vinyl groups located at the terminal positions ($R^1$ and $R^2$) in formula F1.

When special properties are needed, other non-functional monovalent hydrocarbyl and halogenated monovalent hydrocarbyl groups may be substituted at the sites Z1–Z6 of formula (F1). For example, alkyl groups having 1 to 18 carbon atoms, e.g., methyl, ethyl, propyl, butyl, hexyl, dodecyl, octyl, and octadecyl; cycloalkyl groups having 5 to 7 ring carbon atoms, e.g., cyclohexyl and cycloheptyl; aryl groups having 6 to 18 carbon atoms, e.g., phenyl, naphthyl, tolyl, xylyl; aralkyl groups including benzyl, β-phenylpropyl, β-phenylethyl, and naphthylmethyl; alkoxy groups having 0 to 18 carbon atoms such as hydroxy, methoxy, ethoxy, and dodecyloxy; and halo-substituted hydrocarbon groups such as dibromophenyl, chloromethyl, 3,3,3-trifluoropropyl and chlorophenyl may be employed at all or some of the sites Z1–Z6 of formula (F1). Substituents for these groups may include, for example, halogen, cyano and amino groups. Preferred compounds for sites Z1–Z6 include methyl, methylphenyl, cyanoethyl, and trifluororopropyl.

Another addition-curable compound useful in this invention is a branched organopolysiloxane having the general formula:

(F1.1)

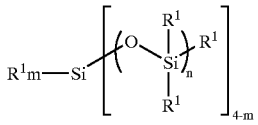

wherein each $R^1$ in formula F1.1 is a functional group or a nonfunctional group as defined above and wherein at least two but preferably not more than one-half of all the $R^1$ groups in the siloxane are functional groups, m represents 0, 1, 2, or 3, and n represents a number having an average value from 1 to about 10,000. Compounds containing more than one branch point as depicted in formula (F1.1) may also be employed.

Another class of suitable addition-curable compounds useful as ethylenically unsaturated siloxane polymers in this invention and which contain the functionality described in formula (F1.1) are the MQ resins. These polymers contain tetrafunctional $SiO_{4/2}$ (Q units) and $R^aR^bR^cSiO_{1/2}$ (M units) where the $R^a$, $R^b$, and $R^c$ are vinyl, methyl, phenyl, ethyl, hydroxy, or hydrogen. MQ resins where $R^a$ and $R^b$ are methyl and $R^c$ is vinyl are most suitable for use as ethylenic compounds in this invention. Typically these would not be used as the only ethylenic compound in the formulation, but rather in combination with other ethylenic compounds, especially the vinyl terminated polydimethylsiloxane polymers shown in formula F1 where $R^1$ and $R^2$ are vinyl.

The polysiloxanes are made from other siloxanes by a well known equilibrium process and typically range in viscosity from about 0.01 Pa s to about 2500 Pa s (See, for example, *Silicone Compounds: Register and Review,* 5th ed. United Chemical Technologies, Inc. (formerly Hüls America), Bristol, Pa.). The preferred molecular weight of the polysiloxane often depends upon the desired viscosity of the silicone composition prior to crosslinking. In general, as the molecular weight is increased the viscosity of the uncrosslinked composition correspondingly increases. For use as molding compositions for the elastomers of the invention, the average value of n in formula F1 is preferably about 10 to about 6000, more preferably about 50 to about 2000, and most preferably about 100 to about 1000. Mixtures of more than one molecular weight may likewise be utilized. preferred range of viscosities for the vinyl polysiloxane component is about 0.010 to 250 Pa s, preferably 0.1 to 100 Pa s, and most preferably 0.5 to 50 Pa s.

The preferred amount of the silicone polymer component in the silicone composition of the invention will vary depending upon the desired physical properties of the silicone composition (such as the desired uncured viscosity, cured hardness, etc.). In part due to the wide range of acceptable molecular weights for the silicone polymer component, and the many types of adjuvants which may be added to the polymer, this amount will vary widely. The presently preferred amount of silicone polymer component in the silicone composition is about 10% to about 100% by weight, more preferably about 20% to about 90% by weight, and most preferably about 20% to about 80% by weight, based on the total weight of the composition.

(2) Crosslinker

A second component of the silicone compositions of the present invention is a crosslinker. The term "crosslinker," as used herein, refers to polymers that react with the functional group or groups of the polymer chains (i.e., preferably $R^1$ and $R^2$ of formula F1) of the silicone polymer (organopolysiloxane) component to simultaneously lengthen and connect them laterally and form a crosslinked network. In contrast to a thermoplastic polymer, which softens and flows upon heating, a crosslinked polymer, after crosslinking, is characteristically incapable of further flow.

The crosslinker component of the silicone composition used in the elastomeric members of the invention can be a polymeric or non-polymeric compound. The crosslinker contains at least two silicon-hydrogen linkages per molecule, with no more than three hydrogen atoms attached to any one silicon atom. Preferably, no more than two hydrogen atoms are attached to any one silicon atom, and, most preferably, no more than one hydrogen atom is attached to any one silicon atom. These compounds are well known in the art and are disclosed, for example, in U.S. Pat. No. 3,159,662 to Ashby; U.S. Pat. No. 3,220,972 to Lamoreaux; and U.S. Pat. No. 3,410,886 to Joy, which are incorporated herein by reference.

Some classes of compounds having a silicon-bonded hydrogen atom which can be used in the invention are:

(a) organohydrogensilanes having the empirical formula, $$(H)_a(R^3)_bSi_c \quad \text{(F2)}$$

wherein each $R^3$ can be the same or different and represents an organic group, preferably selected from the group consisting of monovalent hydrocarbyl groups, monovalent hydroalkoxyl groups and halogenated monovalent hydrocarbyl groups, c represents an integer having a value from 1 to 10,000, a represents an integer having a value at least 2 and less than or equal to c when c is greater than 1, and the sum of a and b equals the sum of 2 and two times c;

(b) organohydrogencyclopolysiloxanes having the empirical formula, $$(H_dR^3_eSiO)_f \quad \text{(F3)}$$

wherein $R^3$ is as defined above, f represents an integer having a value from 3 to 18, d represents an integer having a value at least 2 and less than or equal to f, and the sum of d and e equals two times f; and (c) organohydrogenpolysiloxane polymers or copolymers having the empirical formula, $$(H)_g(R^3)_hSi_jO_{(j-1)} \quad \text{(F4)}$$

wherein $R^3$ is as defined above, j represents an integer having a value from 2 to 10,000, g represents an integer having a value at least 2 and less than or equal to j, and the sum of g and h equals the sum of 2 and two times j.

Among the groups represented by $R^3$ include, for example, alkyl groups having 1 to 18 carbon atoms, e.g., methyl, ethyl, propyl, octyl, and octadecyl, cycloalkyl groups having 5 to 7 ring carbon atoms, e.g., cyclohexyl and cycloheptyl, aryl groups having 6 to 18 carbon atoms, e.g., phenyl, naphthyl, tolyl, xylyl, alkoxyl groups having 0 to 18 carbon atoms, e.g., hydroxyl, methoxyl, ethoxyl, propoxyl, and combinations of alkyl and aryl groups, e.g., aralkyl groups, such as, benzyl and phenylethyl, and halo-substituted groups thereof, e.g., chloromethyl, chlorophenyl, and dibromophenyl. Preferably, the $R^3$ group is methyl or both methyl and phenyl. The $R^3$ group can also be an unsaturated aliphatic group having 1 to 20 carbon atoms, such as alkenyl or cycloalkenyl, e.g., vinyl, allyl and cyclohexenyl. When the $R^3$ group is a group with aliphatic unsaturation, the silicon compound containing silicon-hydrogen linkages can be reacted with itself to form a crosslinked structure or network.

A preferred compound having silicon-bonded hydrogen useful in this invention is a polyorganohydrogenpolysiloxane having the general formula:

(F5)

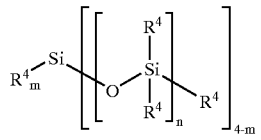

wherein each $R^4$ can be the same or different and represents hydrogen, an alkyl group having 1 to 18 carbon atoms, a cycloalkyl group having 3 to 12 carbon atoms, or a phenyl group, at least two but not more than one-half of all the $R^4$ group in the siloxane being hydrogen, m represents 0, 1, 2, or 3, and n represents a number having an average value from about 1 to about 10,000. Compounds containing more than one branch point as depicted in formula (F5) may be employed.

Also useful in the present invention as crosslinkers and which contain the functionality described in formula (F5) are the MQ resins. These polymers contain tetrafunctional $SiO_{4/2}$ (Q units) and $R^dR^eR^fSiO_{1/2}$ (M units) where the $R^d$, $R^e$, and $R^f$ are vinyl, methyl, phenyl, ethyl, hydroxy, or hydrogen. MQ resins where $R^d$ and $R^e$ are methyl and $R^f$ is hydrogen are most suitable for use as ethylenically unsaturated compounds in this invention. Typically these would not be used as the only crosslinker in the formulation, but rather in combination with other crosslinkers, especially the organohydropolysiloxane copolymers shown in formula (F4).

The amount of the crosslinker component should be sufficient to provide the desired degree of crosslinking of the silicone composition. In part due to the wide range of acceptable molecular weights for the silicone polymer (organopolysiloxane) component, it is presently believed that the amount of crosslinker is best described in terms of the ratio of Si—H groups to functional groups (e.g. vinyl) on the organopolysiloxane in the silicone composition. The presently preferred ratio of Si—H groups to functional groups ("SiH:F") is about 1:1 to about 20:1, more preferably about 1:1 to about 10:1, and most preferably about 1.3:1 to about 4:1. In a particularly preferred embodiment of the present composition, the ratio of hydride groups in formula F4 to functional groups in formula F1 ($R^1$, $R^2$=vinyl) is 1:1 to 10:1, preferably 1.1:1 to 5:1, and most preferably 1.3:1 to 3:1. The presently preferred amount of crosslinker component in the total composition is between 0.2% and 90% by weight, more preferably between 0.2% and 20% by weight, and most preferably between 0.2% and 10% by weight.

(3) Catalyst

The third component of the silicone compositions used to make the elastomeric members in the electronic assemblies of the present invention is a catalyst. A wide range of catalysts may be used, and any catalyst may be used which provides a fully cured silicone composition within about 1 hour at a temperature of about 30° C.

Suitable hydrosilation catalysts for use in the present invention include those compounds which promote the addition reaction between the ethylenically unsaturated groups on the silicone polymer and the silicon-bonded-hydrogen groups on the crosslinker. Examples of suitable catalysts include platinum or platinum compound catalysts exemplified by chloroplatinic acid, a complex of chloroplatinic acid and an alcohol, a complex of platinum and an olefin, a complex of platinum and a ketone, a complex of platinum and a vinylsiloxane, colloidal platinum, a complex of colloidal platinum and a vinylsiloxane etc., palladium, a mixture of palladium black and triphenylphosphine, etc.; or rhodium or rhodium compound catalysts. Also suitable for use in the present invention are radiation activated hydrosilation catalysts. For example, one may employ: ($\eta^4$-cyclooctadiene)diarylplatinum complexes (as described in U.S. Pat. No. 4,530,879, Drahnak, which is herein incorporated by reference), ($\eta^5$ -cyclopentadienyl)trialkylplatinum complexes (as described in U.S. Pat. No. 4,510,094, Drahnak, which is herein incorporated by reference); or ($\eta^5$-cyclopentadienyl)tri($\sigma$-aliphatic)-platinum complexes and a sensitizer that is capable of absorbing visible light (as described in U.S. Pat. No. 4,916,169, Boardman et al.) with traditional vinyl-siloxane polymers and crosslinkers. Platinum or platinum compound catalysts are presently preferred. Alternatively, Pt(II) beta-diketonate complexes as disclosed in U.S. Pat. No. 5,145,886 or the photohydrosilation catalyst systems described in U.S. patent application Ser. Nos. 07/626,904 and 07/627,009 are suitable for use in the present invention.

The presently preferred catalyst material for use in the silicone compositions used to make the elastomeric members in the assemblies of the invention is a catalyst of the "Karstedt" type. Karstedt platinum catalysts are described in U.S. Pat. Nos. 3,715,334, 3,775,452 and 3,814,730 which are herein incorporated by reference. In general, to produce a Karstedt catalyst, (A) platinum halide must be used with (B) a complexing material. The complexing material is an unsaturated organosilicon material, preferably selected from: (a) unsaturated silanes, (b) unsaturated linear or branched siloxanes, and (c) unsaturated cyclic siloxanes.

A Karstedt catalyst can be made by (1) contacting an unsaturated organosilicon material and a platinum halide to produce a mixture having a concentration of available inorganic halogen; (2) treating the resulting mixture to remove available inorganic halogen; and, (3 ) recovering from (2 ), a platinum-siloxane complex having available inorganic halogen of less than 0.1 gram atoms of halogen, per gram atom of platinum. Preferably, the resultant complex should be substantially halogen free.

As used herein, the term "available inorganic halogen," will designate halogen that can be detected by a modification of ASTM designation D-1821-63 for "Inorganic Chloride." The modified procedure is substantially as described in the ASTM D-1821-63 procedure, except that a mixture of glacial acetic acid and acetone is used in place of the recited acetone. Atomic Absorption Spectroscopy was used to determine gram atoms of platinum in the platinum-siloxane complexes (see, for example, R. Dockyer and G. F. Hames, *Analyst,* 84, 385 (1959)).

Preferably the platinum-siloxane complexes can be made by reacting a platinum halide with an unsaturated linear, branched or cyclic siloxane having at least one structural unit of the formula:

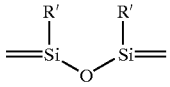

(F6)

where the unsatisfied valences ("Si═") of the above structural unit can be satisfied by R, R' and oxygen radicals and where R and R' are saturated or unsaturated aliphatic or aromatic groups such as, for example, alkyl, vinyl, allyl and phenyl. Most preferably R' is a vinyl group.

The platinum halides which can be employed in the practice of the invention are, for example, $H_2PtCl_6.nH_2O$ and metal salts such as $NaHPtCl_6.nH_2O$, $KHPtCl_6.nH_2O$, $Na_2PtCl_6.nH_2O$, $K_2PtCl_6.nH_2O$. In addition, $PtCl_4.nH_2O$ and platinous type halides such as $PtCl_2$, $Na_2PtCl_4.nH_2O$, $H_2PtCl_4.nH_2O$, $NaHPtCl_4.nH_2O$, $KHPtCl_4.nH_2O$, $K_2PtBr_4$ and platinum halide complexes with aliphatic hydrocarbon as taught in Ashby Pats. U.S. Pat. Nos. 3,159,601 and 3,159,662, for example $[(CH_2{=}CH_2).PtCl_2]_2$; $(PtCl_2.C_3H_6)_2$, etc., may be employed. Other platinum halides which can be utilized are shown by Lamoreaux Pat. U.S. Pat. No. 3,220,972, such as the reaction product of chloroplatinic acid hexahydrate and octyl alcohol, etc.

The amount of the platinum catalyst component in the silicone composition used to make the elastomers of the invention should be sufficient to provide the desired degree of curing of the silicone composition within one hour at a temperature less than about 30° C., preferably within less than about 20 minutes at 30° C., and most preferably within less than about 10 minutes at 30° C. In part due to the wide range of acceptable molecular weights for the silicone polymer (organopolysiloxane) component, this amount of catalyst required may be described in terms of the ratio of Pt atoms in the catalyst complex to functional groups on the polyorganosiloxane. The presently preferred ratio of Pt atoms to unsaturated alkyl functional groups ("Pt:F") is between 1:10 and 1:2000, preferably between 1:20 and 1:1000 and most preferably between 1:30 and 1:500. Sufficient catalyst should be used such that the weight ratio of Pt to all reactive ingredients in the composition is greater than about 50 ppm, preferably greater than about 100 ppm, and most preferably greater than about 200 ppm. If the functional group on the organopolysiloxane component is vinyl, the stoichiometric (platinum to vinyl; e.g. Pt:F) ratio should be less than about 1:200, preferably less than about 1:125, and most preferably less than about 1:75.

A preferred formulation table for the silicone composition used to make the elastomeric members in the electronic assemblies of the invention is provided in Table 1 below:

TABLE 1

| Preferred formulation Table | Range | Preferred | Most Preferred |
|---|---|---|---|
| Stoichiometric (hydride to vinyl) Ratios: | 10:1 to 1:1 | 5:1 to 1.1:1 | 3:1 to 1.3:1 |
| Stoichiometric (V:Pt) Ratios: | <200:1 | <125:1 | <75:1 |
| ppm by weight Pt to reactive ingredients: | >50 | >100 | >200 ppm |
| Viscosity of vinyl polysiloxane (Pa s) | 0.010 to 250 | 0.1 to 100 | 0.5 to 50 |

TABLE 1-continued

| Preferred formulation Table | Range | Preferred | Most Preferred |
|---|---|---|---|
| Viscosity of hydrogen polysiloxane (mPa-s) | 5 to 500 | 10 to 200 | 20 to 100 |

The following abbreviations apply to Table P1, as well as to Table P2 below:

[2]"LMW polysiloxane" = Y-7942 vinyldimethylsiloxy terminated polydimethylsiloxane with a viscosity of approx. 2 Pa s; available from Witco Corp., OSi Specialties Group, Danbury, Ct.

[3a]"platinum catalyst" = the platinum catalyst solution of Preparatory Example 1.

[3b]"platinum catalyst" = platinum catalyst solution similar to that in Preparatory Example 1 substituting 2.0 Pa s polymer for the 0.3 Pa s polymer.

[4a]"crosslinker" = organohydrogenpolysiloxane having a viscosity of approximately 24 to 38 mPa s and approximately 0.2 wt % hydride; available from Witco Corp., OSi Specialties Group, Danbury, CT.

[4b]"crosslinker" = organohydrogenpolysiloxane having a viscosity of approximately 50 to 70 mPa s and approximately 0.15 wt % hydride; available from 3M, St. Paul, MN.

[5]Surfactant available from Witco Corp., OSi Specialties Group, Danbury, Ct, under the trade designation Silwet L-77.

[6]"microcrystalline silica" = mineral silica filler available from Unimen Specialty Minerals, Cairo, IL., under the trade designation Imsil A-25.

[7]"DVTMDS" = 1,1,3,3-tetramethyl-1,3-divinyldisiloxane; set time inhibitor; available from United Chemical Technology, Inc., Bristol, PA.

[8]Silica filler; surface treated precipitated silica available from Degussa Corp, Dublin, OH, under the trade designation Sipernat D-13.

[9]"pigment" = blue pigment paste available from Ferro Corp., South Plainfield, NJ, under the trade designation V-1232.

[10]"pigment" = green pigment paste available from Ferro Corp., South Plainfield, NJ, under the trade designation SV-2608.

[11]"pigment" = Rocket Red pigment available from DAY-GLO Color Corp., Cleveland, OH, under the trade designation AX-13-5.

(4) Optional Additives

The silicone compositions used to make the elastomeric members in the electronic assemblies of the present invention may optionally include amine stabilizers for the Karstedt catalyst complex as described in U.S. Pat. No. 5,371,162 to Konings, which is incorporated herein by reference. In addition, the silicone compositions may optionally include fillers such as, for example, metal particles, silica, quartz, calcium carbonate or metal oxides, appropriate polymerization initiators and inhibitors, as well as surfactants, pigments, modifying agents, copolymerizable and non-copolymerizable cosolvents, and the like.

The curing reaction of the silicone compositions used to make the elastomeric members in the electronic assemblies of the present invention is triggered, in general, by mixing together the catalyst, crosslinker, silicone polymer, and other optional additives. The term "curing," as used herein, implies that the chemical reactions that form the crosslinks proceed to cause the system to "crosslink," preferably at or near room temperature.

Prior to use the components are preferably pre-mixed. For example, a component "A" of the mixture, which may contain the organopolysiloxane with vinyl functional groups and the platinum catalyst complex, may be mixed with a component "B," which may contain the organohydrogenpolysiloxane and optionally additional vinyl-containing organopolysiloxane. The mixture is then applied to an appropriate mold to produce an elastomeric member of the desired shape for a particular electronic assembly.

In the mold, as the material begins to cure its viscosity increases. The term "working time," as used herein, refers to the time between: (1) the beginning of the curing reaction, when the vinyl-containing organopolysiloxane, the organohydrogenpolysiloxane, and the platinum catalyst are mixed, and (2) the time the curing reaction has proceeded to the point at which it is no longer practical to perform further physical work upon the system, e.g. to reform it, for its intended purpose. When the reaction has proceeded to phase (2), the material is said to have reached its "gel point," where it no longer easily flows or adapts to new shapes.

The working time preferably provides enough time to comfortably mix and place the silicone composition into its desired form. Preferably, the working time at a temperature of about 30° C. is about 1 minute to about 30 minutes, most preferably about 1 minute to about 10 minutes. Longer working times are also acceptable.

When the crosslinking reaction is substantially complete the material is said to be "set." This "setting time" is likewise an important parameter for a silicone spring member as it is crucial that the material remain in a mold until it has completely set. Premature removal from the mold may result in a distorted component which will continue to crosslink in the distorted position. For this reason, it is desirable to have a short setting time.

The term "setting time," as used herein, refers to the time sufficient curing has occurred to allow removal of the silicone material from the surface being replicated without causing permanent deformation. The setting time may be approximated, for example, by measuring the torque of the reacting composition on a oscillatory rheometer. When the torque value reaches a maximum value the material is said to be fully set. An arbitrary torque value which is less than the typical maximum value may alternatively be used as a relative approximation of the set time. Typically, the setting time is defined as when the torque value obtained reaches about 90% of its maximum value. In general, shorter setting times are preferred over longer setting times. Preferably, the setting time is less than about 10 minutes at a temperature of about 30° C. More preferably the setting time is less than the sum of 5 minutes plus the working time at 30° C. Most preferably the setting time is just longer than the desired working time.

The curing reaction used to prepare the silicone compositions in the elastomeric members in the electronic assemblies of the present invention proceeds within a commercially feasible time at or near room temperature, e.g. about 25 to about 40° C. In contrast, many "high" temperature cured silicone elastomers cure only at relatively high temperatures (e.g. >100° C.) and are stable (i.e., the curing reaction is retarded) at room temperature for prolonged periods (1 hour or more). The setting rate of the silicone compositions used to prepare the elastomeric members of the invention may be adjusted by varying the amount of catalyst and crosslinker within the ranges specified above.

The rate of setting may be adjusted further by the incorporation of well known inhibitors and/or retarders. One such inhibitor is 1,3,5,7-tetramethyl-1,3,5,7-tetravinylcyclotetrasiloxane, which reacts competitively with the catalyst to slow the crosslinking reaction. The rate of setting may be increased by applying heat. However, application of heat changes the final shapes of the elastomeric member as a result of mismatch in thermal expansion characteristics between the mold and the elastomer. This change in shape is minimized by minimizing the temperature increase needed to speed cure. The ideal material would have a setting time of less than about 5 minutes at temperatures preferably no higher than about 90° C., more preferably no higher than about 60° C., and most preferably no higher than about 30° C.

These lower temperatures increase the dimensional fidelity of the final part and decrease the processing equipment requirements. Low temperatures and rapid cure times simplify and reduce the cost of processing on an assembly line or in a continuous web process. In addition, the lower temperature and rapid cure means that the electronic component itself may serve as all or part of the mold for the spring elastomer, which reduces both the equipment (fewer molds) and process steps needed (removal of elastomer from molds, storage in inventory, and subsequent insertion into the electronic component).

Once fully cured, the silicone compositions used to prepare the elastomeric members of the invention have excellent stress relaxation resistant properties. When an external force is applied to an elastomeric member made from the silicone compositions described above, the member provides a corresponding counter force. The term "stress-relaxation resistance," as used herein, refers to the ability of a material to withstand externally applied mechanical forces by providing a matching counter-force which does not change significantly over a defined amount of time at a defined temperature (for example 1000 hours at 125 C). A highly stress-relaxation resistant material would thus exhibit minimal change in its matching force over the course of the experiment. The preferred range of stress relaxation resistance for the elastomeric members of the invention is 60% to 80% initial force retention, more preferred is 80 % to 90 % initial force retention, and most preferred is 90% or better initial force retention.

The method used to measure the force retention is a modified version of ASTM D 395 and ASTM D 575. In the modified test, the sample is allowed to cool to room temperature while in the clamping fixture; then, immediately following removal of the sample from the fixture, the force required to recompress the sample to the original compressile deflection is recorded. This is compared to the force required to originally compress the sample before aging. The percent force retention is calculated by taking the ratio between the aged and original values.

As noted above, a silicone elastomer used in an electronic connector must not produce by-products during curing or aging that may corrode or otherwise damage delicate electronic components. For the purposes of the present invention, a very low weight loss is required at the temperatures the electronic connector may experience during solder reflow procedures. The elastomeric members of the invention preferably have a weight loss less than about 5%, preferably less than about 2%, when heated to temperatures required for solder reflow (about 245° C. to about 320° C.).

The present invention will be further understood in view of the following examples which are merely illustrative and not meant to limit the scope of the invention. Unless otherwise indicated, all parts and percentages are by weight.

EXAMPLES

Preparatory Example 1

Preparation of a Karstedt Catalyst

A three neck flask was fitted with a mechanical stirrer, reflux condenser, thermometer, and nitrogen purge and placed in a water bath. The flask was charged with 3,000 parts ethanol and 1,200 parts 1,1,3,3-tetramethyl 1,3-divinyl disiloxane and then purged with nitrogen for 5 minutes. Six hundred parts hexachloroplatinic acid was added to the solution and the mixture stirred until the acid was substantially dissolved. Eighteen hundred parts sodium bicarbonate was then added over a 5 minute period. The water bath was heated to 60° C. and then stirred for 2.5 hours. After cooling, the solution was filtered, washed with 150 parts ethanol and transferred to a flask containing 6,000 parts dimethylvinylsiloxy terminated polydimethylsiloxane. The flask was placed on a rotary evaporator and stripped at 45° C. until the vacuum reaches 0.5–1.0 mm Hg to produce a Karstedt type catalyst solution with a platinum concentration of approximately 2.3–3.0%.

Preparatory Examples 2–7

Formulations

Stock catalyst compositions and stock crosslinker compositions were prepared by combining the following ingredients in a Ross double planetary mixer and mixing for 60 minutes at 30 rpm under vacuum as listed in Table P1:

TABLE P1

| Catalyst & Base Formulations | | | | | | |
|---|---|---|---|---|---|---|
| Preparatory Ex.: | 2 | 3 | 4 | 5 | 6 | 7 |
| approximate ratios: | | | | | | |
| Si—H/Si—Vi Ratio | 1.72 | 2.64 | 2.62 | 2.61 | 2.59 | 2.56 |
| Si—Vi/Pt Ratio | 139 | 48 | 49 | 49 | 49 | 49 |
| ppm Pt to reactive ingredients | 116 | 326 | 325 | 326 | 325 | 327 |
| Catalyst Ingredients (parts by weight) | | | | | | |
| LMW polysiloxane[2] | 46.24 | 61.85 | 56.97 | 52.08 | 47.20 | 42.31 |
| platinum catalyst | 0.374[3b] | 1.45[3a] | 1.33[3a] | 1.22[3a] | 1.10[3a] | 0.99[3a] |
| micro-crystalline silica[6] | 49.12 | 30.00 | 35.00 | 40.00 | 45.00 | 50.00 |
| Sipernat D-13[8] | 3.00 | 6.00 | 6.00 | 6.00 | 6.00 | 6.00 |
| Silwet L-77[5] | 0.757 | 0.70 | 0.70 | 0.70 | 0.70 | 0.70 |
| pigment | 0.505[9] | — | — | — | — | — |
| Base Ingredients (parts by weight) | | | | | | |
| LMW polysiloxane[2] | 37.14 | 43.82 | 40.30 | 36.72 | 33.14 | 29.57 |
| crosslinker[4b] | 6.67[4a] | 17.42 | 16.00 | 14.58 | 13.16 | 11.74 |
| Silwet L-77[5] | 0.757 | 0.70 | 0.70 | 0.70 | 0.70 | 0.70 |
| Sipernat D-13[8] | 3.00 | 6.00 | 6.00 | 6.00 | 6.00 | 6.00 |
| micro-crystalline silica[6] | 48.93 | 31.50 | 36.50 | 41.50 | 46.50 | 51.50 |
| DVTMDS[7] | .0035 | 0.04 | 0.04 | 0.04 | 0.04 | 0.04 |
| pigment | 3.50[10] | 0.50[11] | 0.50[11] | 0.50[11] | 0.50[11] | 0.50[11] |

Preparatory Examples 8–12

Formulations

Stock catalyst compositions and stock crosslinker compositions were prepared by combining the following ingredients in a Ross double planetary mixer and mixing for 60 minutes at 30 rpm under vacuum as listed in Table P2:

TABLE P2

| Catalyst & Base Formulations | | | | | |
|---|---|---|---|---|---|
| Preparatory Ex.: | 8 | 9 | 10 | 11 | 12 |
| approximate ratios: | | | | | |
| Si—H/Si—Vi Ratio | 1.73 | 2.54 | 2.60 | 2.60 | 2.60 |
| Si—Vi/Pt Ratio | 73 | 49 | 48 | 48 | 48 |
| ppm Pt to reactive ingredients | 218 | 324 | 327 | 328 | 326 |
| Catalyst Ingredients (parts by weight) | | | | | |
| LMW polysiloxane[2] | 45.72 | 59.30 | 48.48 | 48.34 | 48.19 |
| platinum catalyst[3a] | 0.70[3b] | 1.30 | 1.13 | 1.13 | 1.12 |
| microcrystalline silica[6] | 48.40 | 32.00 | 44.26 | 44.12 | 43.99 |
| Sipernat D-13[8] | 3.93 | 6.00 | 6.03 | 6.02 | 6.00 |
| Silwet L-77[1] | 0.75 | 0.70 | 0.10 | 0.40 | 0.70 |
| pigment | 0.50[9] | 0.70[9] | — | — | — |
| Base Ingredients (parts by weight) | | | | | |
| LMW polysiloxane[2] | 36.80 | 36.54 | 33.70 | 33.60 | 33.50 |
| crosslinker[4b] | 6.63[4a] | 15.10 | 13.35 | 13.31 | 13.27 |
| Silwet L-77[5] | 0.77 | 0.70 | 0.10 | 0.40 | 0.70 |
| Sipernat D-13[8] | 3.93 | 6.00 | 6.03 | 6.02 | 6.00 |
| microcrystalline silica[6] | 48.51 | 38.62 | 46.27 | 46.14 | 46.00 |
| DVTMDS[7] | 0 | 0.03 | 0.03 | 0.03 | 0.03 |
| pigment | 3.36[9] | 3.00[10] | 0.54[11] | 0.54[11] | 0.54[11] |

Preparatory Example 13

Shaping by Molding and Casting

Equal volumes of the Catalyst composition and the Base composition of Preparatory Example 2 were placed in separate barrels of a two-part syringe (i.e., a syringe with two parallel barrels of essentially equal diameter) equipped with a Kenics static mixer. A Kenics static mixer consists of a circular pipe within which are fixed a series of short helical elements of alternating left- and right-hand pitch. The helical design of the central element causes a transverse flow to arise in the plane normal to the pipe axis. As a consequence, radial mixing of the two compositions is achieved. A complete description of the fluid mechanics of a Kenics static mixer may be found on pages 327 and 328 of *Fundamentals of Polymer Processing,* by Stanley Middleman.

The mixed compound was dispensed from the tip of the static mixer directly into a plastic mold having cavity dimensions measuring 0.100 inch (0.254 cm) wide×0.100 inch (0.254 cm) deep and 6 inches (15.2 cm) long, and open to the air along the 6 inch×0.100 inch face. The material was allowed to cure for 5 minutes. After the material had finished curing, the mold was opened and the cured elastomer part was removed.

Preparatory Example 14

Shaping by Casting

Equal volumes of the Catalyst composition and the Base composition of Preparatory Example 2 were placed in separate barrels of a two-part syringe (i.e., a syringe with two parallel barrels of essentially equal diameter) equipped with a Kenics static mixer.

The mixed compound was dispensed from the tip of the static mixer directly into a plastic cavity having dimensions measuring 0.120 inch (0.305 cm) deep×4 inches (10.2 cm) square, and open to the air along the top face. After flattening the top surface by pressing a flat plate against it in a press, the material was allowed to cure for 5 minutes. After the material had finished curing, the elastomer part was removed from the casting cavity.

Preparatory Example 15

Fabrication of Composites by Overmolding

The cured sample made in example 13 was inserted into a plastic mold having cavity dimensions measuring 0.100 inch (0.254 cm) wide×0.200 inch (0.508 cm) deep and 6 inches (15.2 cm) long, and open to the air along the 6 inch×0.100 inch face. Equal volumes of the Catalyst composition and the Base composition of Preparatory Example 8 were placed in separate barrels of a two-part syringe equipped with a Kenics static mixer. The mixed compound was dispensed from the tip of the static mixer directly into the cavity, onto the sample from example 13. The compound was allowed to cure for 5 minutes in the mold, in contact with the earlier cured sample. After the material had finished curing, the composite elastomer part was removed from the casting cavity. The two elastomers showed excellent adhesion to each other.

Performance Example 1

Heat Aging Performance of Formulations 2–12

Figure 5A:
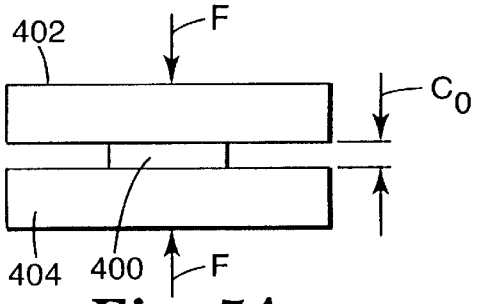
FIG. 5A is a cross-sectional view of a test apparatus used to determine the stress relaxation resistance of an elastomeric material.
Figure 5B:
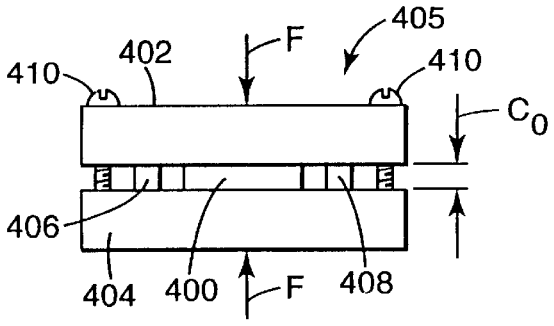
FIG. 5B is a cross-sectional view of a test apparatus used to determine the stress relaxation resistance of an elastomeric material.

Elastomer samples of each formulation (2–12) were prepared according to the procedure of preparatory example 14. Following this, stress relaxation experiments were performed on each sample as follows:

Stress Relaxation Test Procedure (Performed for Each Sample, see FIGS. 5A–5B)

1. The elastomer sample 400 was cut to the following size: width=0.150" (3.81 mm), height=0.120" (3.048 mm), length=0.500" (12.7 mm).
2. The elastomer was centered between two stiff plates 402, 404. The compressive spacing, $C_0$, needed to achieve 11.1 lb (5.03 kg) force was measured by compressing the elastomer 400 in the height dimension. This was done using a Super DHT spring tester available from Larson Systems, Inc., Minneapolis, Minn.
3. Two sets of shims 406, 408 were selected, each equal the thickness $C_0$.
4. The elastomer was centered between the plates 402, 404, and a shim set 406, 408 was placed along each end of the elastomer (refer to FIG. 5B) to provide a test fixture 405. The top plate 402 was firmly attached to the bottom plate 404 using a set of screws 410. The shims 406, 408 were used to set the spacing between the plates 402, 404 to spacing $C_0$ as determined in step 2. In this example, the stiff plates 402, 404 were aluminum, measuring 2.1 inch (5.3 cm) long, 0.35 inch (0.89 cm) thick, and 0.5 inch (1.3 cm) wide for the top plate and 2.1 inch (5.3 cm) long, 0.5 inch (1.3 cm) thick, and 0.5 inch (1.3 cm) wide for the bottom plate.

5. The elastomer was aged in the stress relaxation test fixture in a 125° C. oven for 1 month.
6. The stress relaxation test fixture was removed from the oven and cooled to room temperature while compressed.
7. The test fixture was unscrewed and the elastomer sample 400 was removed.
8. The force exerted by the aged elastomer sample was measured when it was recompressed to the original spacing $C_0$.
9. The percent force retained was calculated using the following formula:

$$F_{aged}/F_{initial}\times 100\%/, \text{ where } F_{initial}=11.1 \text{ lb } (5.03 \text{ kg}).$$

The performance data for these formulations are reported in table P3. It is seen that these rapid curing silicone elastomer formulations exhibit excellent stress relaxation resistance. The performance in this series ranged from 79% to 92% force retention after stress relaxation aging at 125° C. for 4 weeks. Performance example 2 shows data obtained on several commercially available castable silicone elastomer formulations.

TABLE P3

Stress Relaxation Performance of Formulations 2–12

| Room Temperature Cured Formulation of Preparatory Example # | Percent Initial Force Retained after 4 weeks at 125° C. |
|---|---|
| 2 | 81% |
| 3 | 92% |
| 4 | 85% |
| 5 | 90% |
| 6 | 91% |
| 7 | 79% |
| 8 | 90% |
| 9 | 91% |
| 10 | 86% |
| 11 | 83% |
| 12 | 83% |

Performance Example 2

Heat Aging Performance of Commercially Available Castable Formulations

Elastomer samples of each commercially available formulation were prepared according to the procedure of preparatory example 14, with the substitution of using the manufacturers recommended cure schedule. Following this, stress relaxation experiments were performed in the same manner as Performance Example 1. The performance data for these formulations are reported in table P4. It is seen that these silicone elastomers do not exhibit the stress relaxation resistance of the formulations disclosed in this invention.

TABLE P4

Stress Relaxation Performance of Commercially Available Silicones

| Comparative Elastomer | Percent Initial Force Retained after 4 weeks at 125° C. |
|---|---|
| Sylastic E (casting) | 58% |
| Sylgard 184 (casting) | 61% |
| Sylastic 595 (casting) | 0% |
| Sylgard 186 (casting) | 68% |

TABLE P4-continued

Stress Relaxation Performance of Commercially Available Silicones

| Comparative Elastomer | Percent Initial Force Retained after 4 weeks at 125° C. |
|---|---|
| Silastic J (casting) | 43% |
| GE 118 (casting) | 20% |

Performance Example 3

Outgassing During Solder Reflow in Air

To simulate an air solder reflow process, a sample of the room temperature cured elastomer formulation of Preparatory Example 2 was tested in a TGA (Thermogravimetric analysis) using a Perkin-Elmer Series 7 Thermal Analysis System.

The sample was tested as made, with no post-baking and no drying prior to test. Only 0.15 wt % was lost in 2 minutes in a 245° C. reflow as measured by TGA (rapid heating at 100° C./minute to 245° C.), this is believed to be due to moisture loss. After 4 minutes, 0.63 wt % was lost.

During a dynamic TGA at 5° C./minute on a second sample, 0.45 wt % was lost by the time the sample reached 200° C. About 1.5 wt % was lost by 350° C., and only above 350° C. did the sample begin to show appreciable weight loss, for example 15% weight loss by 500° C.

These data indicate excellent thermal stability over the temperature range that electronics elastomers are required to sustain.

Performance Example 4

Outgassing During Solder Reflow in Inert Atmosphere

To simulate an inert (nitrogen) solder reflow process, a sample of a room temperature cured elastomer formulation #2 was tested in a TGA as described in Performance Example 3.

The sample was tested as made, with no post-baking and no drying prior to test. About 0.094 wt % was lost during a 1 hour Nitrogen purge; this presumably is due to moisture evaporating out of the elastomer. Only 0.16 wt % was lost in a 245° C. reflow in nitrogen simulation using a TGA (rapid heating at 100° C./minute to 245° C.). This is believed to be due to moisture loss. After 4 minutes, 0.53 wt % was lost.

About 0.098 wt % was lost during a 1 hour Nitrogen purge on a second sample; this again is presumably due to moisture evaporating out of the elastomer. During a subsequent dynamic TGA at 5° C./minute, 0.37 wt % was lost by the time the sample reached 200° C. Only 1.8 wt % was lost by 380° C., and only above 350° C. did the sample begin to show appreciable weight loss, for example 10% weight loss by 500° C.

These data again indicate excellent thermal stability over the temperature range that electronics elastomers are required to sustain.

It will be understood that the exemplary embodiments described herein in no way limit the scope of the invention. Other modifications of the invention will be apparent to those skilled in the art in view of the foregoing description.

These descriptions are intended to provide specific examples of embodiments which clearly disclose the present invention. Accordingly, the invention is not limited to the described embodiments or to the use of the specific elements, dimensions, materials or configurations contained therein. All alternative modifications and variations which fall within the spirit and scope of the appended claims are included in the present invention.

We claim:

1. An electronic assembly comprising:

A. a first electronic component with a first contacting site;

B. a second electronic component with a second contacting site;

C. a force bearing member which maintains contact between the first contacting site on the first electronic component and the second contacting site on the second electronic component, wherein the force bearing member is made of a cured composition comprising:

a) an addition curable silicone polymer comprising an average of at least 2 unsaturated functional groups per molecule;

b) a crosslinker comprising an average of at least 2 silicone-hydrogen linkages per molecule, wherein, prior to cure, the ratio of Si—H linkages to functional groups on the silicone polymer (SiH:F ratio) is about 1:1 to about 20:1; and c) a catalyst, wherein said catalyst is present in an amount sufficient to permit curing of the composition in less than about 20 minutes at a temperature of about 30° C.

2. An electronic assembly as claimed in claim 1, wherein the functional groups on the silicone polymer are selected from the group consisting of vinyl, allyl, 1-hexenyl, and cyclohexenyl.

3. An electronic assembly as claimed in claim 1, wherein the crosslinker is selected from the group consisting of organohydrogensilanes, organohydrogencyclopolysiloxanes, and organohydrogenpolysiloxanes.

4. An electronic assembly as claimed in claim 1, wherein the catalyst comprises a compound selected from the group consisting of platinum, palladium and rhodium.

5. An electronic assembly as claimed in claim 1, wherein the functional group on the silicone polymer is a vinyl group, wherein the SiH:F ratio is about 10:1 to about 1:1, and wherein the catalyst is a Karstedt catalyst present in an amount sufficient to provide a Pt to functional group ratio (Pt:F ratio) of less than about 1:200.

6. An electronic assembly as claimed in claim 5, wherein the catalyst is present in amount sufficient to provide a Pt:F ratio of less than about 1:75.

7. An electronic assembly as claimed in claim 5, wherein said cured composition has a force retention of at least 75% as measured according to a modified ASTM-395 procedure.

8. An electronic assembly, comprising:

(a) an elastomeric member; and (b) an electronic component adjacent the elastomeric member, wherein the electronic component comprises at least one electrical contacting site, and the elastomeric member maintains connection between the at least one electrical contacting site and at least one second electrical contacting site on a second electronic component, and wherein the elastomeric member comprises a cured composition, comprising:

i) an organopolysiloxane comprising an average of at least 2 vinyl groups per molecule;

ii) a crosslinker comprising an average of at least 2 silicone-hydrogen linkages per molecule, wherein, prior to cure, the ratio of Si—H linkages to vinyl groups on the organopolysiloxane is about 1:1 to about 10:1; and iii) a Karstedt catalyst present in an amount sufficient to provide a Pt to vinyl ratio of less than about 1:200.

9. An electronic assembly as claimed in claim 8, wherein the crosslinker is selected from the group consisting of organohydrogensilanes, organohydrogencyclopolysiloxanes, and organohydrogenpolysiloxanes.

10. An electronic assembly as claimed in claim 8, wherein the electronic component is a flexible circuit.

11. An electronic assembly as claimed in claim 10, wherein the flexible circuit is attached to the elastomeric member with an adhesive.

12. An electronic assembly as claimed in claim 8, wherein said cured composition has a force retention of at least 75% as measured according to a modified ASTM-395 procedure.

13. An electronic assembly comprising:

a wedge-like male member and a first electronic component attached to the male member, wherein the first electronic component comprises at least one first electrical contacting site, and an elastomeric member between the electronic component and the male member; and a socket-like female member configured to accept the male member and a second electronic component attached to the female member, wherein the second electronic component comprises at least one second electrical contacting site;

wherein when the male member is inserted into the female member, the elastomeric member is biased to maintain electrical interconnection between the first electronic component and the second electronic component; and said elastomeric member comprises a cured composition, comprising:

a) an organopolysiloxane comprising an average of at least 2 vinyl groups per molecule;

b) a crosslinker comprising an average of at least 2 silicon-hydrogen linkages per molecule, wherein, prior to cure, the ratio of Si—H linkages to vinyl groups on the organopolysiloxane is about 1:1 to about 10:1, and c) a Karstedt catalyst present in an amount sufficient to permit curing of the composition in less than about 20 minutes at a temperature of about 30° C.

14. An electronic assembly as claimed in claim 13, wherein said cured composition has a force retention of at least 75% as measured according to a modified ASTM-395 procedure.

15. An electronic assembly as claimed in claim 13, wherein said female member further comprises a second elastomeric member between the female member and the second electronic device.

16. An electronic assembly as claimed in claim 13, wherein the first and second electronic components are flexible circuits.

17. An electronic assembly as claimed in claim 13, wherein at least one of the flexible circuits comprises an array of contacting sites for electrical interconnection to a circuit board.

18. An electronic assembly comprising:

a first substrate with a first major surface, an elastomeric member adjacent the substrate on the first major surface thereof, and a first electronic device mounted adjacent the elastomeric member, wherein the first electronic device comprises at least one first electrical contacting site;

a second substrate with a first major surface, and a second electronic device adjacent the first major surface of the second substrate, wherein the second electronic device comprises at least one second electrical contacting site, wherein when a mechanical force is applied normal to the major surfaces of the first and second substrates, the elastomeric member is biased to electrically interconnect the first electrical contacting site and the second electrical contacting site, and said elastomeric member is made of a cured composition, comprising:

a) an organopolysiloxane comprising an average of at least 2 vinyl groups per molecule;

b) a crosslinker comprising an average of at least 2 silicon-hydrogen linkages per molecule wherein, prior to cure, the ratio of Si—H linkages to vinyl groups on the organopolysiloxane is about 1:1 to about 10:1; and a Karstedt catalyst present in an amount sufficient to permit curing of the composition in less than about 20 minutes at a temperature of about 30° C.

19. An electronic assembly as claimed in claim 18, wherein said cured composition has a force retention of at least 75% as measured according to a modified ASTM-395 procedure.

20. An electronic assembly as claimed in claim 18, further comprising a second elastomeric member between the second substrate and the second electronic component.

21. An electronic assembly as claimed in claim 18, wherein the first and second electronic components are flexible circuits.

22. An electronic assembly comprising:

a substrate with a first major surface, a first electronic device adjacent the first major surface of the first substrate and electrically interconnected thereto, and an elastomeric member between the first electronic device and the first substrate, wherein the first electronic device has at least one first electrical contacting site;

a second substrate with a first major surface, a second electronic device adjacent the first major surface of the second substrate and electrically interconnected thereto, wherein the second electronic device has at least one second electrical contacting site;

wherein when a mechanical force is applied normal to the major surfaces of the first and second substrates, the elastomeric member is biased to reliably electrically interconnect the first electrical contacting site and the second electrical contacting site, and said elastomeric member is made of a cured composition, comprising:

a) an organopolysiloxane comprising an average of at least 2 vinyl groups per molecule;

b) a crosslinker comprising an average of at least 2 silicon-hydrogen linkages per molecule wherein, prior to cure, the ratio of Si—H linkages to vinyl groups on the organopolysiloxane is about 1:1 to about 10:1, and c) a Karstedt catalyst present in an amount sufficient to permit curing of the composition in less than about 20 minutes at a temperature of about 30° C.

23. An electronic assembly as claimed in claim 22, wherein said cured composition has a force retention of at least 75% as measured according to a modified ASTM-395 procedure.

24. An electronic assembly as claimed in claim 22, further comprising a second elastomeric member between the second substrate and the second electronic component.

25. A conducting structure, comprising:

a matrix having a first surface and a second surface, wherein the matrix comprises a cured, room temperature curable silicone composition comprising:

a) an organopolysiloxane comprising an average of at least 2 vinyl groups per molecule;

b) a crosslinker comprising an average of at least 2 silicon-hydrogen linkages per molecule wherein, prior to cure, the ratio of Si—H linkages to vinyl groups on the organopolysiloxane is about 1:1 to about 10:1; and c) a Karstedt catalyst, wherein said composition may be cured in less than about 20 minutes at a temperature of about 30° C.; and conductive particles in the matrix to provide at least one of an electrical and thermal interconnection between a first electronic component and a second electronic component.

26. A conducting structure, comprising:

a matrix having a first surface and a second surface, wherein the matrix comprises a cured composition comprising a) an organopolysiloxane comprising an average of at least 2 unsaturated functional groups per molecule;

b) a crosslinker comprising an average of at least 2 silicon-hydrogen linkages per molecule, wherein, prior to cure, the ratio of Si—H linkages to vinyl groups on the organopolysiloxane is about 1:1 to about 10:1 and c) a Karstedt catalyst, wherein said composition may be cured in less than about 20 minutes at a temperature of about 30° C.; and at least one via extending from the first surface of the matrix to the second surface of the matrix;

a conductive member in the via, wherein said member comprises at least one conductive element.

27. A conducting structure as claimed in claim 26, wherein said conductive elements are selected from the group consisting of metallic particles, ceramic particles, metal coated polymeric particles, metal coated ceramic particles, and metallic wires.

28. A conductive structure as claimed in claim 26, wherein said conductive member further comprises a polymeric binder.

* * * * *

UNITED STATES PATENT AND TRADEMARK OFFICE

CERTIFICATE OF CORRECTION

PATENT NO. : 6,403,226 B1
DATED : June 11, 2002
INVENTOR(S) : Biernath, Rolf W.

It is certified that error appears in the above-identified patent and that said Letters Patent is hereby corrected as shown below:

Title page,
Item [56], References Cited, U.S. PATENT DOCUMENTS, "4,002,621"
should read -- 4,003,621 --

Column 10,
Line 52, insert -- a -- before "preferred"

Column 12,
Line 25, "group" should read -- groups --

Column 15,
Lines 8-29, delete the abbreviations section after Table 1 and insert after Table P1

Column 23,
Line 33, "on" should read -- of --
Line 51, after "in" insert -- an --

Column 25,
Line 18, before "a" insert -- c) --
Line 32, after "a" insert -- first --

Signed and Sealed this

Thirtieth Day of December, 2003

JAMES E. ROGAN
*Director of the United States Patent and Trademark Office*